US005377915A

United States Patent [19]

Volo et al.

[11] Patent Number: 5,377,915

[45] Date of Patent: Jan. 3, 1995

[54] FUEL INJECTION NOZZLE

[75] Inventors: Corrine A. Volo, Webster; Jeffrey A. Rock, West Henrietta, both of N.Y.

[73] Assignee: General Motors Corporation, Detroit, Mich.

[21] Appl. No.: 143,892

[22] Filed: Nov. 1, 1993

[51] Int. Cl.[6] ..... F02M 61/20

[52] U.S. Cl. ..... 239/533.9

[58] Field of Search ..... 239/533.8, 570, 571, 239/900, 533.3, 533.12, 99, 101

[56] References Cited

U.S. PATENT DOCUMENTS

| | | | |
|---|---|---|---|
| 2,756,106 | 7/1956 | Schenk | 299/107.6 |
| 2,812,979 | 11/1952 | Ziesche et al. | 239/511 |
| 3,237,568 | 3/1966 | Morgan et al. | 238/533.8 X |
| 4,641,784 | 2/1987 | Howes | 239/533.8 X |
| 5,070,845 | 12/1991 | Avdenko et al. | 123/470 |
| 5,188,142 | 2/1993 | Lind et al. | 137/223 |

FOREIGN PATENT DOCUMENTS

| | | | |
|---|---|---|---|
| 54612 | 1/1982 | Germany | 239/533.8 |

*Primary Examiner*—Andres Kashnikow
*Assistant Examiner*—Kevin P. Weldon
*Attorney, Agent, or Firm*—Karl F. Barr

[57] ABSTRACT

A fuel injection nozzle has a valve seat assembly with an upstream and a downstream seat interconnected by a longitudinally extending passage and by a bypass extending from a location upstream of the first seat to a chamber located intermediate of the two seats. A popper valve assembly has upstream and downstream valve members interconnected by a spacer member disposed within the chamber and operable relative to respective valve seats to regulate flow through the nozzle. A biasing member urges the valve member into a normally closed position in which the upstream valve member is unseated and the downstream member is seated to interrupt flow therethrough and out of the nozzle. Introduction of a fuel pulse into the nozzle moves the upstream valve member into engagement with its valve seat to thereby unseat the downstream valve member from its valve seat to allow fuel flow through the bypass around the upstream valve/seat wherein the fuel is discharged into the chamber intermediate of the two valve members. The fuel undergoes a pressure drop upon its exit from the bypass and is subject to movement about the chamber and the spacer member to optimize the atomization of the fuel as it exits the nozzle through the open, downstream valve/seat.

2 Claims, 1 Drawing Sheet

FUEL INJECTION NOZZLE

TECHNICAL FIELD

The invention relates to a nozzle for discharging fuel to an internal combustion engine.

BACKGROUND

The fuel injection nozzle disclosed in copending application Ser. No. 08/143,595 filed Nov. 1, 1993 is directed to a nozzle having upstream and downstream valve seats and corresponding valves. The preferred embodiment utilizes a valve body with the two valve seats positioned, relative to one another, so as to allow the two valves, which are spherical members, to touch. At the point of contact, the valve members are fixed, as by welding, so as to define a unitary valve assembly. A bypass extends from a location upstream of the upstream valve and seat to a location intermediate of the two seats, and valves. Fuel delivery from the nozzle occurs when the upstream valve member is in a seated position against the upstream valve seat and the downstream valve member is in an unseated position allowing fuel to flow through the bypass to the location intermediate of the two valves and, subsequently, out of the open downstream valve seat. The embodiment of the nozzle just discussed, necessarily limits the space, or distance between the upper and the lower valve seats in order to facilitate the "touching" of the two valve members. As a result of this reduction in space, defined as chamber length, fuel exiting the bypass may not achieve sufficient momentum for adequate fuel atomization upon exiting the downstream valve seat. It may be desirable to increase the chamber length to ensure adequate fuel preparation, however, it has typically been recognized that such increases have the undesirable effect of increasing the sac volume, which is the volume directly upstream of the downstream valve and seat. Fuel delivery nozzles having large sac volumes are prone to hot fuel handling problems due to the tendency for fuel vaporization within the sac volume under certain high temperature conditions. Fuel vaporization can detrimentally affect the performance characteristics of the nozzle.

SUMMARY

The disclosed invention provides an improved nozzle, for use in a fuel injection system having improved fuel preparation and atomization characteristics.

In a fuel injection nozzle according to the present invention, a tubular nozzle body, adapted to receive fuel, includes a valve seat assembly having first, upstream and second, downstream valve seats, interconnected by a longitudinally extending passage. One or more fluid passages or bypasses extend from upstream of the first valve seat to a location intermediate of the two valve seats. A popper valve assembly includes first, upstream and second, downstream valve members operable to engage their respective upstream and downstream valve seats to regulate fluid flow through the valve assembly. The valve members are operably fixed, relative to one another, to thereby define the longitudinal movement or stroke of the valve assembly, relative to the valve seats. The valve member is urged, by a spring member, towards a normally closed position relative to its associated upstream seat and the downstream valve member is seated against its associated, downstream valve seat. Introduction of a high pressure pulse of fuel into the nozzle body will cause the valve member to move towards an opened position in which the upstream valve member is in a seated position and the downstream valve member is unseated to thereby allow flow through the bypass to the location intermediate of the two valve seats and subsequently out of the injector nozzle through the opened valve seat. Discharge of the pressurized fuel from the bypass into the passage intermediate of the two valve seats initiates the fuel atomization process incident to fuel discharge from the downstream valve seat. The introduction of turbulence or swirl adequate to proper atomization of the fuel exiting the downstream valve/seat may require a chamber length between the upstream and downstream valve seats which is larger than that defined by the diameters of the two valve members. Enlargement of the chamber length in the disclosed nozzle is through one or more spacer members located within the swirl chamber. The spacer members interconnect the upstream and downstream valve members, functioning as an integral part of the valve assembly. The spacer members increase the length and volume of the swirl chamber defined between the valve seats while occupying space which would otherwise be undesirable sac volume. The spacer members may be configured so as to enhance the fuel atomization and, in a preferred embodiment are spherical members fixed together and to the valve members at points of tangential contact.

The details as well as other features and advantages of the fuel injection nozzle of this invention are set forth in the following detailed description and drawings.

DETAILED DESCRIPTION

Figure 1:
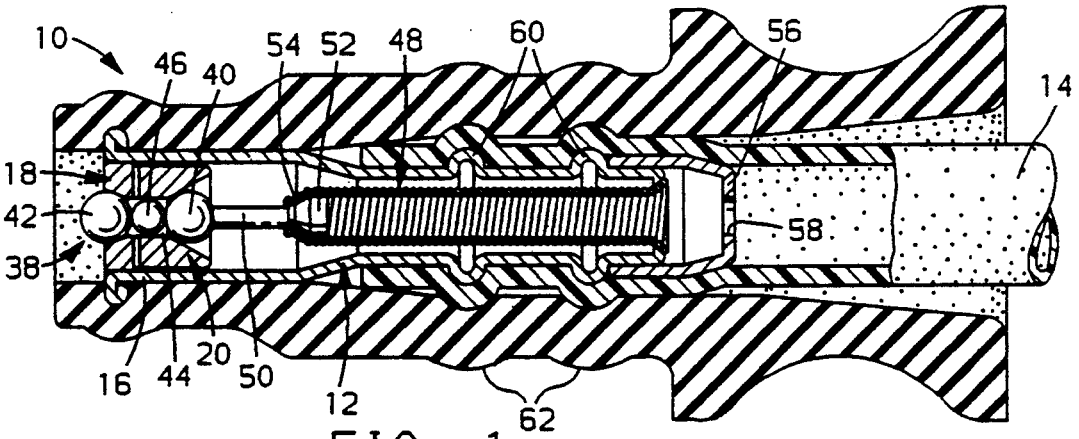
FIG. 1 is a sectional view a fuel injection nozzle embodying features of the present invention.
Figure 2:
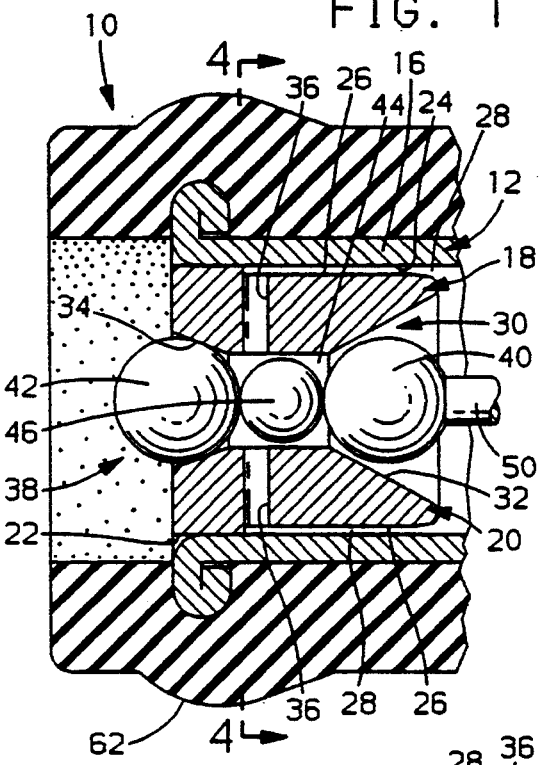
FIGS. 2 and 3 are enlarged partial sectional views of the nozzle of FIG. 1, illustrating various modes of operation.
Figure 3:
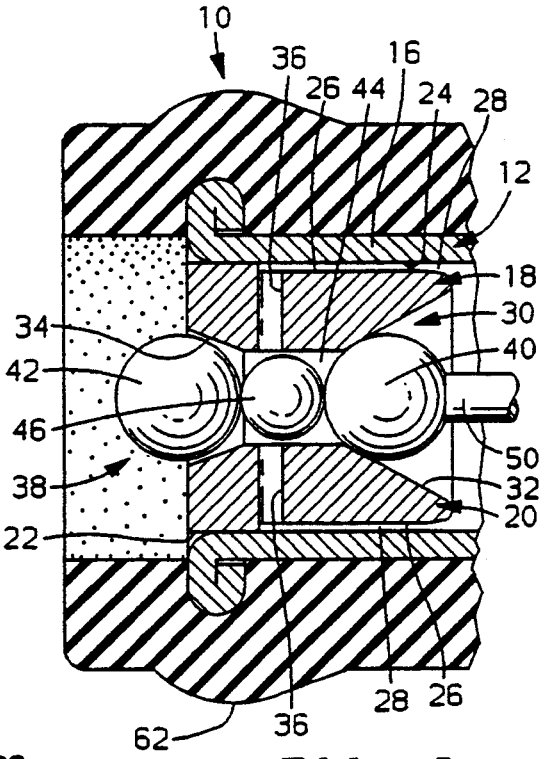

Referring to the drawings, FIG. 1 illustrates a fuel injection nozzle, designated generally as 10, for delivery of fuel to the intake system of an internal combustion engine, not shown. The nozzle 10 has a tubular body 12 adapted to receive fuel from an associated fuel line 14. The downstream end of the body 12 has an end portion 16 which is configured to receive a tubular valve seat assembly 18. The seat assembly 18, illustrated in detail in FIGS. 2 and 3, has a tubular valve seat body 20 with an outer wall 22 for engagement with the inner wall 24 of the end portion 16 of the tubular body 12. The valve seat body 20 is fixed within the end portion 16 such as by an interference fit between the two components, or by welding, or otherwise bonding, so as to establish a leakage free seal therebetween and to support the valve seat assembly 18 within the tubular body 12. Flats 26, FIG. 4, in the outer wall 22 of valve seat body 20, extend from the upstream end of the body towards the downstream end to terminate at a location intermediate of the two ends, defining passages 28 between the tubular body 12 and the valve body 20. Valve seat body 20 has a passage 30 extending longitudinally from the upstream to the downstream ends with a first, upstream valve seat 32 and a second, downstream valve seat 34 extending about opposite ends of the passage 30 such that the valve seats are situated in spaced relationship to one another with the seating surface of the upstream valve seat 32 facing upstream and the seating surface of the downstream valve seat 34 facing downstream.

Figure 4:
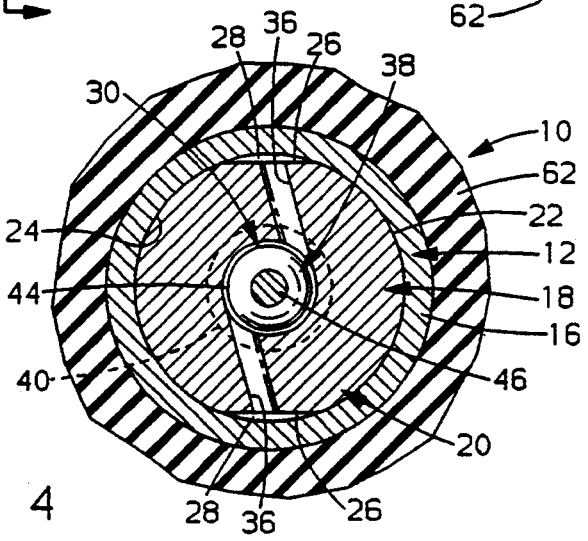
FIG. 4 is a sectional view of the nozzle of FIG. 1 taken along line 4—4 of FIG. 2.

One or more fluid passages 36 are formed in the valve seat body 20 and extend radially inwardly, FIG. 4, from the passages 28 defined by flats 26 to a location with passage 30 intermediate of the upstream and the downstream valve seats 32,34. As such, the passages 28 and 36 define fluid bypasses from a location upstream of the first valve seat 32 to a position downstream thereof.

A valve assembly, designated generally as 38, includes a first, upstream valve member 40 engageable with upstream valve seat 32 to interrupt flow from the tubular body 12 to longitudinal passage 30, and a second, downstream valve member 42 engageable with downstream valve seat 34 to interrupt flow from the passage 30 and out of the nozzle 10. In the embodiment illustrated in the Figures, the valve members 40,42 are defined by two spherical members, such as ball bearings. A chamber 44 is established within the passage 30 between the two valve members 40,42. As will be described in further detail below, the chamber dimensions affect the performance of the nozzle by assisting in the preparation and atomization of fuel as it exits the nozzle. A spherical spacer member 46 is located within the chamber 44 and contacts both valve members tangentially, where the members 40,46,42 are joined, as by welding, to form a valve assembly 38. The radii of the three members, in conjunction with the geometry of the valve seats 32,34 and the length of chamber 44, determine the overall longitudinal movement or stroke of the valve assembly 38 relative to the valve seats.

A helically coiled extension spring 48 is anchored to tubular body 12 and to first, upstream valve member 40 through a shank 50 which is attached to the valve member through welding or bonding at one end. The shank 50 has a head 52 which is surrounded by a section of reduced coils 54 of extension spring 48 to anchor the spring to the valve member 40. The spring 48 is operable to urge the valve assembly 38 towards the upstream, closed direction such that first, upstream valve member 40 is normally lifted off of its associated valve seat 32 and second, downstream valve member 42 is normally biased to engage its associated valve seat 34. Upon introduction of a high-pressure pulse of fuel into the tubular body 12 causing the pressure differential across the valve assembly to reach a desired level, the bias exerted thereon by the extension spring 48 is overcome and the valve assembly 38 moves in the downstream, open direction such that the first, upstream valve member 40 is urged into engagement with its associated valve seat 32 and the second, downstream valve member 42 is displaced from seat 34. In the open position, fuel flows from nozzle body 12 through the passages 28 and 36 to chamber 44 where it is subject to a swirling action prior to its discharge from the injector nozzle through the open downstream valve seat 34. Termination of the fuel pulse results in a movement of the valve assembly 38 towards the closed, upstream position illustrated in FIG. 2 wherein the second, downstream valve member 42 closes against valve seat 34 and the first, upstream valve member 40 lifts off of its seated position against the valve seat 32 under the bias of extension spring 48. The axial position of the valve seat assembly 18 within the nozzle body 12 is adjustable during assembly to thereby adjust the length of the spring 48 and, as a result, the bias exerted by the spring on the valve assembly 38. The adjustment feature allows calibration of the pressure differential across the valve seat assembly 18 at which the valve member is displaced from an open to a closed position.

The valve seat passages 28,36 define a fluid path around the first, upstream valve member 40 and its associated seat 32 with the passages 36 functioning as fixed orifices for fuel flow through the nozzle 10. As fixed orifices, the passages 36 may be used to produce the majority of the pressure drop in the fuel system or to provide the primary fuel metering function. Fuel exiting the passage 36 into fuel preparation chamber 44 is atomized under the influence of the pressure drop experienced by the fuel as it departs the passage and, in addition, by the swirl induced by the orientation of the passages, the length and volume of the chamber 44 and the configuration of the spacer member 46. By providing the spherical spacer member 46 in the chamber 44, the volume of chamber 44 is reduced. As a result, hot fuel handling problems which lead to fuel vaporization and degradation in nozzle performance are minimized. Additionally, the third ball design of the present invention eliminates the requirement of forming a passage through the center of the first, upstream valve member 40 for the passage of an extended shank which would otherwise be used to connect the two valve members in the absence of a spacer member as disclosed herein. Such a passage would be undesirable in that it would add significant complexity to the manufacture of the nozzle due to the difficulty in accurately forming such a passage in a spherical member.

The seating of the upstream valve member 40, when the valve assembly 38 is moved to the open position, limits the opening of the second, downstream valve member 42 relative to its seat 34. The mechanical stop function of the upper valve member 40 minimizes oscillation of the second valve member 42 during the full-on condition of the nozzle thereby resulting in a stabilization of fuel flow out of the nozzle 10. By varying the relative diameters of the two valve members, performance of the nozzle can be affected. As such, upstream valve member 40 may have a larger diameter than downstream valve member 42. The larger diameter of the upstream valve member provides a greater surface area upon which the pressurized fuel acts to open the valve and initiate the injection event and, as a result, the opening rate of the valve is reduced and the dynamic range of the nozzle is increased.

A restriction member 56 may be received over the upstream end of the tubular body 12 and has a calibrated orifice 58 that limits fuel flow into the tubular body. Placement of the orifice 58 at the upstream end of the nozzle assures that fuel is distributed equally to each injector in certain applications in which fuel is distributed to multiple nozzles from a single, pressurized fuel source.

Fuel distribution line 14 is slipped over the tubular body 12 and expands to fit over peripheral beads 60 formed on the body. A mounting bushing 62 has a central bore that accepts portions of the fuel nozzle 10 and fuel line 14. The mounting bushing is insertable into an aperture in the wall of an engine inlet manifold (not shown) in any well known manner.

The present invention discloses a fuel injection nozzle having a dual valve and seat assembly with flow control by means of a bypass. The bypass in the nozzle functions as a fixed orifice for fuel flow and may be used to produce pressure drop and fuel metering in the fuel system.

Fuel exiting the bypass enters a charge preparation chamber located between the two valve members where a swirl is induced to aid in atomization as the fuel exits the chamber through the lower valve seat. To optimize fuel preparation, a lengthened chamber is provided. The chamber houses a connecting member which, in the preferred embodiment disclosed, is a third spherical member. The spherical member connects the two valve members, reduces the volume in the nozzle, and aids the flow of the fuel within the chamber.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiments may be modified in light of the above teachings. The embodiments described were chosen to provide an illustration of the principles of the invention and its practical application to thereby enable one of ordinary skill in the art the utilize the invention in various embodiments and with various modifications as are suited to the particular use contemplated. Therefore, the foregoing description is to be considered exemplary, rather than limiting, and the true scope of the invention is that described in the following claims.

The embodiments of the invention in which an exclusive property or privilege is claimed are defined as follows:

1. A fuel injection nozzle adapted to receive pulsed pressurized fuel from a source, comprising a valve seat assembly having a first, upstream seat and a second, downstream seat, said seats interconnected by a longitudinally extending passage, a first, upstream valve member engageable with said upstream valve seat to regulae fuel flow therethrough and a second, downstream valve member engageable with said downstream valve seat to regulate the flow of fuel therethrough, said valve members and said longitudinally extending passage defining a chamber therebetween, said chamber housing a spacer member having a flow enhancing spherical configuration operable to interconnect said first, upstream and said second, downstream valve members to define a valve assembly, a bypass extending from upstream of said first seat to a location within said chamber and biasing means operable to urge said valve assembly in an upstream direction, against the force of said pressurized fuel such that said first valve member is displaced from said first valve seat and said second valve member is biased into engagement with said second valve seat to interrupt fuel flow through said second valve seat and out of said nozzle, said pulsed pressurized fuel operable to establish intermittent pressure differentials across said valve assembly to thereby overcome the force of said biasing means and urge said valve assembly downstream such that said first valve member is biased to engage said first valve seat to interrupt fuel flow therethrough and said second valve member is displaced from said second valve seat to permit flow through said bypass to said chamber, wherein said fuel is subject to a pressure drop and rapid movement in said chamber to promote atomization of said fuel as it is discharged from said nozzle through said second, downstream valve seat.

2. A fuel injection nozzle adapted to receive pulsed pressurized fuel from a source, comprising a valve seat assembly having a first, upstream seat and a second, downstream seat, said seats interconnected by a longitudinally extending passage, a first, upstream spherical valve member engageable with said upstream valve seat to regulate fuel flow therethrough and a second, downstream spherical valve member engageable with said downstream valve seat to regulate the flow of fuel therethrough, said valve members and said longitudinally extending passage defining a chamber therebetween, said chamber housing a spherical spacer member connected to said first and second spherical valve members at points of tangential contact of said members to define a valve assembly a bypass extending from upstream of said first seat to a location within said chamber and biasing means operable to urge said valve assembly in an upstream direction, against the force of said pressurized fuel such that said first valve member is normally displaced from said first valve seat and said second valve member is normally biased into engagement with said second valve seat to interrupt fuel flow through said second valve seat and out of said nozzle, said pulsed pressurized fuel operable to establish intermittent pressure differentials across said valve assembly to thereby overcome the force of said biasing means and urge said valve assembly downstream such that said first valve member is biased to engage said first valve seat to interrupt fuel flow therethrough and said second valve member is displaced from said second valve seat to permit flow through said bypass to said chamber, wherein said fuel is subject, upon discharge into said chamber, to a pressure drop and rapid movement about said chamber and said spherical spacer member so as to promote atomization of said fuel as it is discharged from said nozzle through said second, downstream valve seat.

* * * * *